US006833517B2

(12) United States Patent
Sotome et al.

(10) Patent No.: US 6,833,517 B2
(45) Date of Patent: Dec. 21, 2004

(54) MULTIPLE SWITCH DEVICE

(75) Inventors: Tsuyoshi Sotome, Ota-Ku (JP); Osamu Furukawa, Ota-Ku (JP); Hiroshi Seki, Ota-Ku (JP); Hideo Hirai, Ota-Ku (JP)

(73) Assignee: Niles Parts Co., Ltd. (JP)

( * ) Notice: Subject to any disclaimer, the term of this patent is extended or adjusted under 35 U.S.C. 154(b) by 476 days.

(21) Appl. No.: 09/739,686

(22) Filed: Dec. 20, 2000

(65) Prior Publication Data

US 2001/0004044 A1 Jun. 21, 2001

(30) Foreign Application Priority Data

Dec. 21, 1999 (JP) ..... 11-363474
Mar. 31, 2000 (JP) ..... P2000-098202

(51) Int. Cl.[7] ..... H01H 9/00
(52) U.S. Cl. ..... 200/5 R; 200/18
(58) Field of Search ..... 200/5 R, 17 R, 200/18, 5 B, 5 C, 42.01

(56) References Cited

U.S. PATENT DOCUMENTS 3,149,215 A 9/1964 Nise et al.
5,291,103 A * 3/1994 Ahmed et al. ..... 318/3
5,329,163 A * 7/1994 Satoh et al. ..... 307/10.1
5,331,260 A * 7/1994 Ahmed ..... 318/282

FOREIGN PATENT DOCUMENTS

| | | |
|---|---|---|
| DE | 84 08 935 | 7/1984 |
| DE | 42 42 100 | 6/1994 |
| DE | 197 57 231 A1 | 7/1999 |
| EP | 09161612 | 6/1997 |
| JP | 60-73141 | 5/1985 |

OTHER PUBLICATIONS

Partial EPO Search Report Feb. 11, 2003.

* cited by examiner

*Primary Examiner*—Kyung Lee
(74) *Attorney, Agent, or Firm*—Rader, Fishman & Grauer PLLC

(57) ABSTRACT

A low cost automotive power window switch having few window operating switches uses a single switch to select which of the four windows to operate, and to control the window locks. The power window switch has a window operating switch 3 for raising and lowering each of the car windows, and a mode selector switch 2 for switching between the windows. The mode selector switch 2 also has a window lock switch function for locking and unlocking the windows.

12 Claims, 8 Drawing Sheets

MULTIPLE SWITCH DEVICE

BACKGROUND OF THE INVENTION

1. Field of the Invention

The present invention relates to a multiple switch device having a single knob used for a plurality of switching operations, and relates more particularly to improvement of a power window switch for opening and closing a plurality of windows in an automobile.

2. Description of Related Art

Power window switches conventionally used for opening and closing (referred to below as "operating") the windows of an automobile are typically provided in the same number as there are windows to operate. This means, for example, that the power window switch panel provided at the driver's seat of a four-door vehicle has four knobs, one for operating the window of each door, a lock knob for locking the window, and a door lock knob. The resulting problem is that a large number of knobs means that the overall size of the switch panel unit is also large. This creates the further problem that the arm rest, for example, where the power window switch unit is installed grows in conjunction with the size of the power window switch unit, and thus protrudes into the passenger cabin from the side of the door.

A power window switch unit according to the related art that has been proposed to solve this problem of numerous window switches is taught in Japanese Utility Patent Laid-open Publication (kokai) 60-73141. This power window switch unit has a selection switch, which is a four-way sliding switch for selecting the window to operate, and up and down operating switches.

The problem, however, is that the selection switch of this power window switch unit according to the related art only enables the raising and lowering operation to be switched to one of four door windows, and cannot switch between more than four positions.

This is particularly a problem in, for example, a van having six windows to operate because the above-noted conventional switch cannot be used. Providing sufficient controls to operate six windows on the power window switch panel obviously requires even more knobs, a larger case, and even greater difficulty placing the panel, for example, in the arm rest.

Furthermore, a selection switch that falls in four directions protrudes greatly above the operating panel surface. The problem here is that it can therefore be easy for the driver to mistakenly touch and operate the switch.

A yet further problem is that a selection switch that falls in four directions is a joystick-like operating knob that swings in four directions. While the driver's window is the most frequently operated window, it is not the easiest to operate, and thus cannot be quickly operated in an emergency.

Furthermore, while it is also conceivable to devise a joystick switch with six operating positions, this greater number of directions in which the switch can be operated further increases the potential for mistakenly operating the wrong window or function.

SUMMARY OF THE INVENTION

It is therefore an object of the present invention to provide a power window switch unit with few knobs and a reduced cost, having a switch used for locking and unlocking the power window switches in addition to selecting between four windows.

A further object of the present invention is to provide a multiple switch device using one knob for a plurality of switching functions, thereby reducing the number of parts and assembly steps, and reducing unit cost.

To achieve these objects, the present invention provides, in a first aspect of the present invention, a switch for operating power windows by means of window operating switches for raising and lowering a windows in a motor vehicle, and a selector switch for selecting the windows that can be operated, where the selector switch also has the functionality of a window lock switch for disabling window operation.

In this power window switch the window operating switch is preferably a single switch; and the selector switch comprises a single switch knob with a contact position for selecting the windows to operate, and a contact position for disabling power window operation.

Yet further preferably, the selector switch has a rotary switch knob, and contact positions arranged as follow: a window lock contact position for disabling window operation in the center; a driver's side contact position for operating the driver's window is right adjacent to the window lock contact position; a right rear window contact position for operating a right rear window is right adjacent to said driver's side contact position; a front passenger window contact position for operating a front passenger window is left adjacent to the window lock contact position; and a left rear window contact position for operating a left rear window is left adjacent to the front passenger window contact position.

Alternatively in a power window switch according to this first aspect of the invention the window operating switch comprises two switches disposed side by side; and the selector switch comprises a single switch knob with a switch for selecting front or back seat window operation and, when pressed, disabling window operation.

Yet further alternatively in a power window switch according to this first aspect of the invention the selector switch comprises both a rotary switch for selecting two contact positions for selecting a front seat and back seat position, and a push-button switch for disabling window operation.

Yet further alternatively in a power window switch according to this first aspect of the invention the selector switch comprises a switch movable in two directions for selecting front window operation or rear window operation, and a switch for disabling window operation.

A further switch for operating the power windows of an automobile and having a window operating switch for raising and lowering a vehicle window, and a selector switch for selecting a window to be operated by window operating switch, is characterized in another aspect of the present invention by the selector switch combining the functions of a rocker switch for moving a knob in two directions to select operation of a front seat window or rear seat window, and a push-lock switch for disabling and enabling window operation when the knob is pressed.

The selector switch in this aspect of the present invention preferably is in a contact position for operating a front seat window when the knob of selector switch is in an upright position, and is in a contact position for operating a back seat window when the knob of the selector switch is rocked to one side.

A multiple switch device for operating automobile power windows in a first row, second row, and third row according to a further aspect of the present invention has first to fourth window operating switches for operating first row, second row, and third row power windows; and a selector switch for selecting whether the third and fourth window operating switches operate the power windows of the second row or third row.

Preferably in this case the selector switch combines functions of a rocker switch for moving in two directions to select operation of a second row window or a third row window, and a push-lock switch for disabling and enabling window operation.

Yet further preferably, the selector switch is in a contact position for operating a second row window when the knob of selector switch is in an upright position, and is in a contact position for operating a third row window when the knob is rocked to one side.

A power window switch according to a further aspect of the present invention comprises a knob having protruding from the bottom thereof an operating lever for operating a switch unit, and a single operating part enabling push-action and rocker-action operations; a rocker body movably supported to a case on a pivot with operating lever of knob passing freely up and down therethrough; a case having a through-hole for operating lever passing therethrough; and a plurality of switch units operated by movement of first and second sliding studs, which engage a shaped slot formed in the operating lever of the knob.

Preferably in this power window switch the knob has a cam* on a side of operating lever; the rocker body has a lock pin for engaging the cam and a leaf spring for urging the lock pin, and forms a suitable surface contacted by a suitable body, which is urged by a suitable spring; and the case has a positioning part for placing the knob. The through-hole, a tubular protrusion forming a blind hole for holding a suitable spring, and stud hole for pivotably supporting the rocker body are formed inside the positioning part.

Yet further preferably in this power window switch, the shaped slot formed in the operating lever has a longitudinal slot in which the first sliding stud floats when the knob is pressed, a sloped slot, contiguous to the longitudinal slot, for pushing and moving the second sliding stud when the knob is pressed, and an escape slot in which second sliding stud moves freely when the knob is rocked to one side.

A multiple switch device according to a yet further aspect of the present invention comprises a switch having protruding from a bottom thereof an operating lever for operating switch units, and a rocking knob; a movable selector disposed to the operating lever of the switch for operating the two switch units. One of the switch units is operated by movement of a sliding stud engaging a first notch formed in the movable selector; and the other switch unit is operated by movement of a sliding stud engaging a second notch formed in the movable selector.

Other objects and attainments together with a fuller understanding of the invention will become apparent and appreciated by referring to the following description and claims taken in conjunction with the accompanying drawings.

DESCRIPTION OF THE PREFERRED EMBODIMENTS

The preferred embodiments of the present invention are described below with reference to the accompanying figures.

Figure 1:
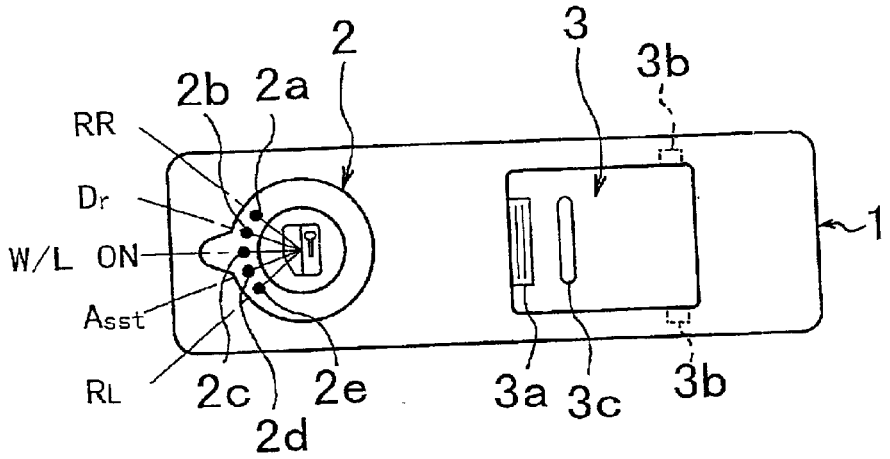
FIG. 1 is a plan view of a first preferred embodiment of the present invention.
Figure 2:
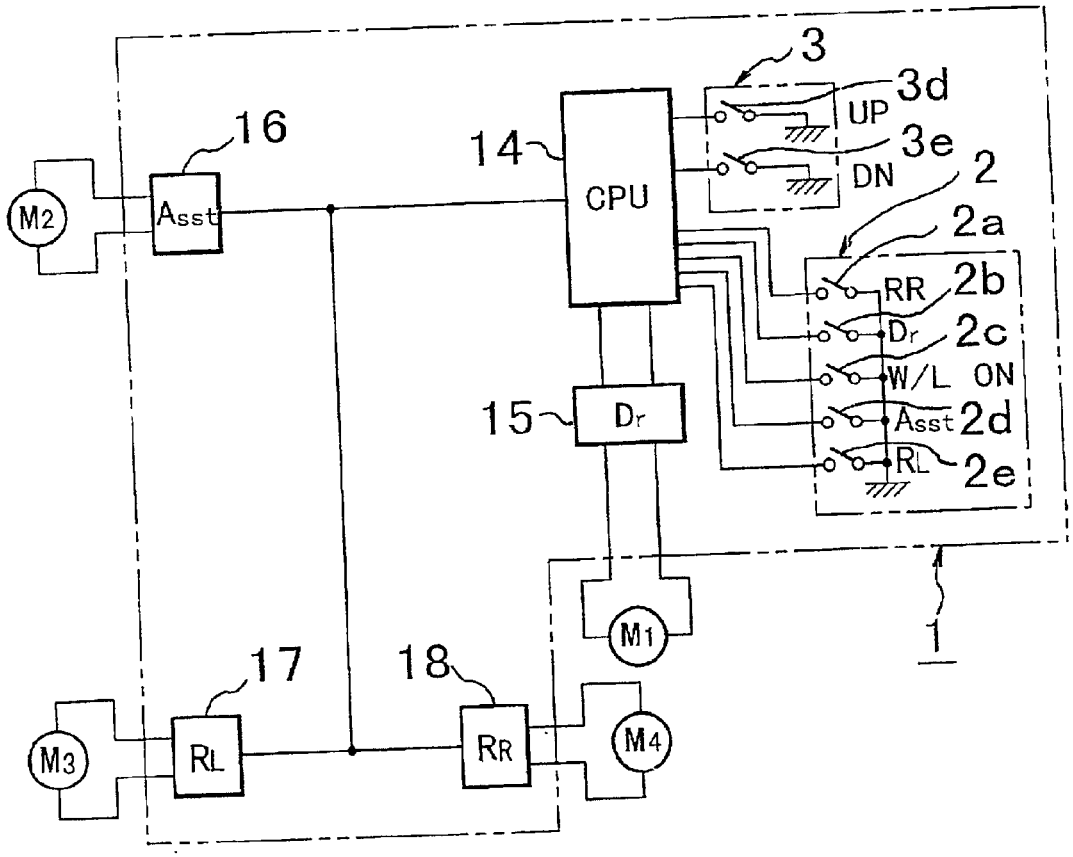
FIG. 2 is an electrical circuit diagram of a first preferred embodiment of the present invention.

Embodiment 1 (FIG. 1 and FIG. 2)

FIG. 1 and FIG. 2 show a power window switch according to a first preferred embodiment of the present invention. This first preferred embodiment of the invention is described next below with reference to FIGS. 1 and 2.

As shown in these figures, the case 1 of an automotive power window switch has two window control switches: a mode selector switch 2, which is a combination rotary switch and push-button switch, and a window operating switch 3, which is a rocker switch for opening and closing the window. These window control switches are aligned with the front-back direction of the vehicle. The case 1 is disposed, for example, in the arm rest on the driver's side door. It should be noted that because case 1 has a small number of window control switches, case 1 can be downsized, and can thus be installed in a slimmer arm rest.

The mode selector switch 2 is a five position rotary switch with five contact positions 2*a*, 2*b*, 2*c*, 2*d*, and 2*e*.

In this exemplary embodiment of the invention contact position 2*a* (RR) is the position for operating the right rear window. Contact position 2*b* (Dr) is for operating the driver's window. Contact position 2*c* (W/L ON) is for locking the power window switches for all but the driver's window. Contact position 2*d* (ASST) is for operating the front passenger-side window. Contact position 2*e* (RL) is for operating the left rear window.

The contact positions 2*a* to 2*e* of the mode selector switch 2 are matched to the seat locations inside the cabin. Thus, the window lock contact position 2*c* (W/L ON) is set to the center position of mode selector switch 2. Contact position 2*b* (Dr) for the driver's window is set to the immediate right of contact position 2*c* (W/L ON); contact position 2*a* (RR) for the right rear window is then to the right of contact position 2*b* (Dr); contact position 2*d* (ASST) for the front passenger side window is to the immediate left of contact position 2*c* (W/L ON); and contact position 2*e* (RL) for the left rear window is to the left of contact position 2*d* (ASST).

By thus matching the contact positions 2*a* to 2*e* of the mode selector switch 2 to the location of seats in the vehicle, the operator does not need to look at the mode selector switch 2 to operate it, and mode selector switch 2 can thus be operated by blind touch.

The window operating switch 3 is a two-step rocker switch that can be operated by pulling up or pushing down with the switch pivoting on a stud 3*b*. An indicator 3*c* can be used for night lighting with the indicator 3*c* turning on when the headlights (not shown in the figure) are turned on, or it can be used as an on/off indicator with the indicator 3*c* turning on only when the window operating switch 3 is in the on position.

Operation of this mode selector switch 2 and window operating switch 3 is described next below with reference to the circuit diagram in FIG. 2.

Referring to FIG. 2, power window switch case 1 in which the electrical circuitry is housed is installed, for example, to the arm rest of the door. Motor M1 is built in to the driver's door, and is electrically connected to CPU 14 by way of motor controller 15. Motor controller 15 controls raising and lowering the driver's window.

Motor M2 is built in to the front passenger-side door, and is electrically connected to CPU 14 by way of motor controller 16. Motor controller 16 controls raising and lowering the passenger-side window. Motor M3 is built in to the left rear door, and is electrically connected to CPU 14 by way of motor controller 17, which controls raising and lowering the left rear window. Motor M4 is built in to the right rear door, and is electrically connected to CPU 14 by way of motor controller 18, which controls raising and lowering the right rear window.

As noted above, mode selector switch 2 has contact positions 2*a* to 2*e*. One side of each contact position 2*a* to 2*e* is connected to CPU 14, and the other is to ground. The window operating switch 3 has an up contact 3*d* for raising the window, and a down contact 3*e* for lowering the window. One side of each contact 3*d* and 3*e* is connected to CPU 14, and the other is to ground.

Thus connected, if mode selector switch 2 is set, for example, to contact position 2*b* (Dr) for the driver's window, and window operating switch 3 is operated to the first step in the up position, up contact 3*d* contacts the fixed contact for as long as the window operating switch 3 is held at this first contact position, causing motor M1 to turn and the driver's window to rise. When the window operating switch 3 is then released, the up contact 3*d* returns automatically to the off position, motor M1 stops, and the window stops moving.

If the window operating switch 3 is operated to the second step up, a solenoid (not shown in the figure) in the motor controller 15 holds the switch at this second contact position, or the equivalent circuit state is held electrically by means of a relay (not shown in the figure), so that up contact 3*d* remains in contact with the fixed contact even if released by the driver, and the driver's window rises automatically all the way closed. When the window is completely closed, the up contact 3*d* of window operating switch 3 returns to the off position, motor M1 stops operating, and the window stops moving.

If mode selector switch 2 is set, for example, to contact position 2*b* (Dr) for the driver's window, and window operating switch 3 is operated to the first step down, down contact 3*e* contacts the fixed contact for as long as the window operating switch 3 is held at this first contact position, causing motor M1 to reverse and the driver's window to descend. When the window operating switch 3 is then released, the down contact 3*e* returns automatically to the off position, motor M1 stops, and the window stops moving.

If the window operating switch 3 is operated to the second step down, a solenoid (not shown in the figure) in the motor controller 15 holds the switch at this second contact position, or the equivalent circuit state is held electrically by means of a relay (not shown in the figure), so that down contact 3*e* remains in contact with the fixed contact even if released by the driver, and the driver's window descends automatically all the way open. When the window is completely open, the down contact 3*e* of window operating switch 3 returns to the off position, motor M1 stops operating, and the window stops moving.

The other windows can also be operated as described above by setting the mode selector switch 2 to the appropriate contact position 2*a*, 2*d*, or 2*e*. To operate the right rear window, for example, the driver simply sets the mode selector switch 2 to contact position 2*a* (RR).

The driver can similarly operate the front passenger side window by setting mode selector switch 2 to contact position 2*d* (ASST), or can operate the left rear window by setting mode selector switch 2 to contact position 2*e* (RL). Furthermore, setting mode selector switch 2 to contact position 2*c* (W/L ON) disables the power window switch at each of the passenger windows so that the passengers cannot raise or lower the windows.

A power window switch according to this preferred embodiment of the invention thus requires uses only two window operating switches, thus reducing the number of switches and reducing cost. Furthermore, by reducing the number of switches for operating the rear windows, this first embodiment of our invention provides a power window switch that is small and which can prevent unintentional operation of a rear window power switch when attempting to operate a switch for the front windows.

Figure 3:
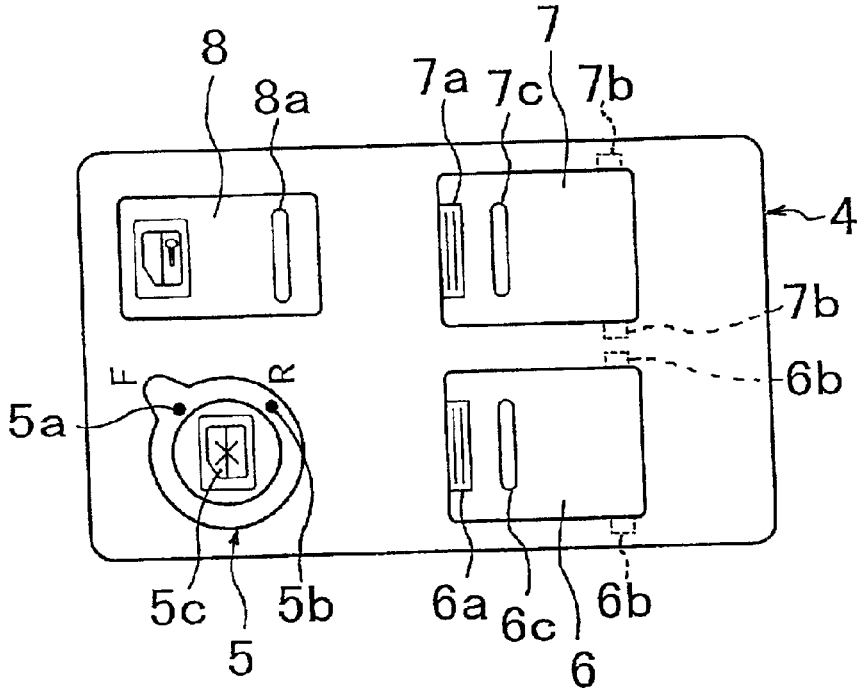
FIG. 3 is a plan view of a second preferred embodiment of the present invention.

Embodiment 2 (FIG. 3)

A second preferred embodiment of an automotive power window switch according to the present invention is described next below with reference to FIG. 3.

As shown in FIG. 3, the case 4 of an automotive power window switch according to this exemplary embodiment has four window control switches: a mode selector switch 5, which is a combination rotary switch and push-button switch for selecting front or back window operation, and locking and unlocking the power window switches; a left window operating switch 6 comprising a rocker switch and the like, for operating the front or back window on the left side; a right window operating switch 7 comprising a rocker switch and the like, for operating the front or back window on the right side; and a door lock switch 8 for locking and unlocking the doors. The case 4, for example, is mounted in the arm rest on the driver's side door. The four window control switches are aligned with the front-back direction of the vehicle.

The mode selector switch 5 is, for example, a knob comprising both a rotary switch with two contact positions 5*a* and 5*b* for selecting the front or rear windows, and a push-button window lock switch that can be pressed to disable opening and closing the windows.

Contact position 5*a* (F) is the switch position for operating the front windows, and contact position 5*b* (R) is the switch position for operating the rear windows. Note that the contact positions of the mode selector switch 5 are arranged to match the vehicle so that the contact position 5*a* (F) for the front windows is to the front, and the rear window contact position 5*b* (R) is to the back. The mode selector switch 5 can thus be intuitively operated by blind touch to the desired position. Furthermore, the windows can be locked, that is, the power window switches at all non-driver window positions can be disabled, by pressing push-button 5*c*.

The right and left window operating switches 6 and 7 are two-step rocker switches that can be operated by pulling up or pushing down with the switch pivoting on a stud 6*b*, 7*b*, respectively. Indicators 6*c*, 7*c*, and 8*a* can be used for night lighting or as an on/off indicator as described above.

With a power window switch thus comprised, the driver sets the mode selector switch 5 to contact position 5*a* (F) and uses right window operating switch 7 to operate the right front window. If mode selector switch 5 is set to contact position 5*a* (F) and right window operating switch 7 is lifted to the first step, the right front window rises. When the right window operating switch 7 is released, the switch returns to the off position, the motor stops, and the window stops moving.

If the driver lifts the right window operating switch 7 to the second step, a solenoid (not shown in the figure) holds the switch at this second contact position, or the equivalent circuit state is held electrically by means of a relay (not shown in the figure), so that operation continues until the window rises all the way closed. When the window is completely closed, right window operating switch 7 returns to the off position, the motor stops, and the window stops moving.

If the driver sets the mode selector switch 5 to contact position 5*b* (R) and presses left window operating switch 6 down to the first step, the left rear window descends. When the switch is released, it returns to the off position, the motor stops, and the window stops moving.

If the driver presses the left window operating switch 6 down to the second step, a solenoid (not shown in the figure) holds the switch at this second contact position, or the equivalent circuit state is held electrically by means of a relay (not shown in the figure), so that operation continues until the window descends to the completely open position. When the window is completely open, left window operating switch 6 returns to the off position, the motor stops, and the window stops moving.

Pressing the door lock switch 8 locks all doors.

By thus integrating controls for the front and rear windows, a power window switch according to this second preferred embodiment of the present invention uses only four switches, thus reducing the number of controls and unit cost. Furthermore, by integrating the switches for the front and rear windows, this second preferred embodiment of the invention provides a power window switch that is small overall and can prevent such unintentional operation as operating a switch for a rear window when intending to operate one of the front windows.

It will be obvious to one with ordinary skill in the related art that the rotary switch and push-button components of the mode selector switch 5 can be separately formed and disposed. In this case, the knob for operating the mode selector switch 5 is a rotary knob with two contact positions 5*a* and 5*b* for operating the front and rear windows, and the push-button switch for the window lock switch for disabling power window switch operation is disposed inside the rotary knob.

Figure 4:
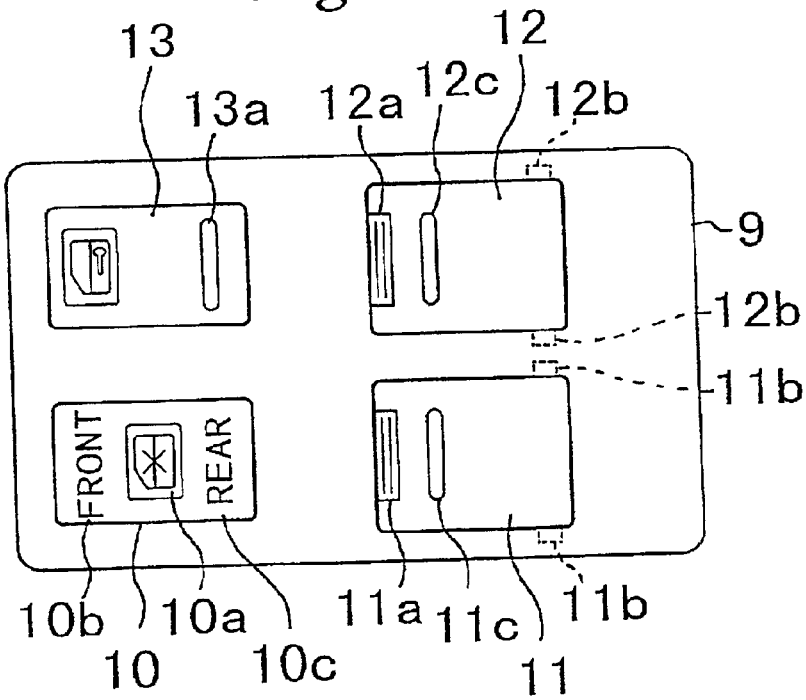
FIG. 4 is a plan view of a third preferred embodiment of the present invention.

Embodiment 3 (FIG. 4)

A third preferred embodiment an automotive power window switch according to the present invention is described next below with reference to FIG. 4.

As shown in FIG. 4, the case 9 of an automotive power window switch according to this exemplary embodiment has four window control switches: a selector switch 10, which is a combination rocker switch and push-button switch for selecting front or back window operation and controlling the window lock; a two-step left window operating switch 11 for operating the front or back window on the left side; a two-step right window operating switch 12 for operating the front or back window on the right side; and a door lock switch 13 for locking and unlocking the doors. The case 9 is mounted, for example, in the arm rest on the driver's side door. The window control switches are aligned with the front-back direction of the vehicle.

The selector switch 10 combines the functions of a rocker switch with two operating positions, and a push-button switch for the window locks. The rocker switch has a FRONT position 10*b* and a REAR position 10*c* controlling whether a front or rear window is operated. The driver depresses the push-button switch 10*a* in the middle of the selector switch 10 to disable the power window switches.

To operate either of the front windows, the driver sets the selector switch 10 to the front window 10*b* (FRONT) position. To operate the rear windows, selector switch 10 is set to the rear window 10*c* (REAR) position. Depressing the push-button switch 10*a* disables operating the windows using any power window switch other than the one at the driver's seat.

The right and left window operating switches 11 and 12 are two-step rocker switches that can be operated by pulling up or pushing down with the switch pivoting on a stud 11*b*, 12*b*, respectively. Indicators 11*c*, 12*c*, and 13*a* can be used for night lighting or as an on/off indicator as described above.

With a power window switch thus comprised, the driver sets the selector switch 10 to front window 10*b* (FRONT) and uses right window operating switch 12 to operate the right front window. If in this case right window operating switch 12 is lifted to the first step, the motor turns and the right front window rises while the switch is held at the first contact position. When the switch is released, it returns to the off position, the motor stops, and the window stops moving.

If the driver lifts the right window operating switch 12 to the second contact position, a solenoid (not shown in the figure) holds the switch at this second contact position, or the equivalent circuit state is held electrically by means of a relay (not shown in the figure), so that operation continues until the window rises all the way closed. When the window is completely closed, right window operating switch 12 returns to the off position, the motor stops, and the window stops moving.

If the selector switch 10 is set to the rear window 10*c* (REAR) position and the left window operating switch 11 is depressed to the first contact position, the left rear window descends and opens while the switch is held at the first contact position. When the switch is released, it returns to the off position, the motor stops, and the window stops moving.

If the driver pushes the left window operating switch 11 to the second contact position, a solenoid (not shown in the figure) holds the switch at this second contact position, or the equivalent circuit state is held electrically by means of a relay (not shown in the figure), so that operation continues until the window is completely open. When the window is completely open, left window operating switch 11 returns to the off position, the motor stops, and the window stops moving.

Pressing the door lock switch 13 locks all doors.

A power window switch according to this preferred embodiment of the invention uses only four control switches as described above, thus reducing the number of controls and reducing unit cost. Furthermore, by integrating the switches for the front and rear windows, this third preferred embodiment of the invention provides a power window switch that is small overall and can prevent such unintentional operation as operating a switch for a rear window when intending to operate one of the front windows.

It will be obvious to one with ordinary skill in the related art that the selector switch 10 can be alternatively comprised using a three position (front, back, and center) rocker switch. The selector switch 10 in this case preferably has two contact positions for selecting the front or rear windows when the switch should be moved toward front or rear, i.e., a front window 10*b* (FRONT) position and a rear window 10*c* (REAR) position, and a window lock contact position in the center for disabling power window switch operation as previously described.

Embodiment 4 (FIGS. 5 to 11)

A fourth preferred embodiment of the present invention is described next below with reference to FIG. 5 to FIG. 11. This fourth preferred embodiment of the invention is described with reference to a automotive power window switch for operating four door windows.

The case 21 of this automotive power window switch has a first control location 21*a* in which a knob 22*l*, for example, is mounted, a second control location 21*b*, third control location 21*c*, and fourth control location 21*d*. The case 21 is mounted, for example, in the arm rest on the driver's side door.

Rocker body 24 and operating lever 22*f* of selector switch 22 are installed to first control location 21*a*. Note that the selector switch 22, further described below, combines the functions of a push-lock switch and a rocker switch. Inside first control location 21*a* are formed: a stud 21*g* for supporting rocker body 24; through-hole 21*i* for passing operating lever 22*f* so that operating lever 22*f* can rock freely; and spring hole 21*h*, which is a blind hole for holding a suitable spring 29. Note that the spring hole 21*h* is a cylindrical protrusion to which suitable spring 29 is inserted.

Selector switch 22 also functions as a window lock switch for locking and unlocking the windows by pressing knob 22*l*. By rocking knob 22*l*, selector switch 22 is also used to switch operation of the first window operating switch 30*a* and the second window operating switch 30*b* between raising and lowering the front driver and passenger windows, or the rear right and left windows.

A door lock switch 36, which is typically a rocker switch, is located at the second control location 21*b*. The function of this door lock switch 36 is to lock and unlock the doors in response to the rocking operation of knob 36*a*.

The first window operating switch 30*a*, which is a two-step rocker switch, is located at the third control location 21*c*. When knob 30*f* of first window operating switch 30*a* is pushed to a first contact position, the driver's side or right rear window can be manually lowered (opened). When knob 30*f* is further depressed to a second contact position, the driver's side or right rear window can be automatically lowered to the fully open position.

Figure 11:
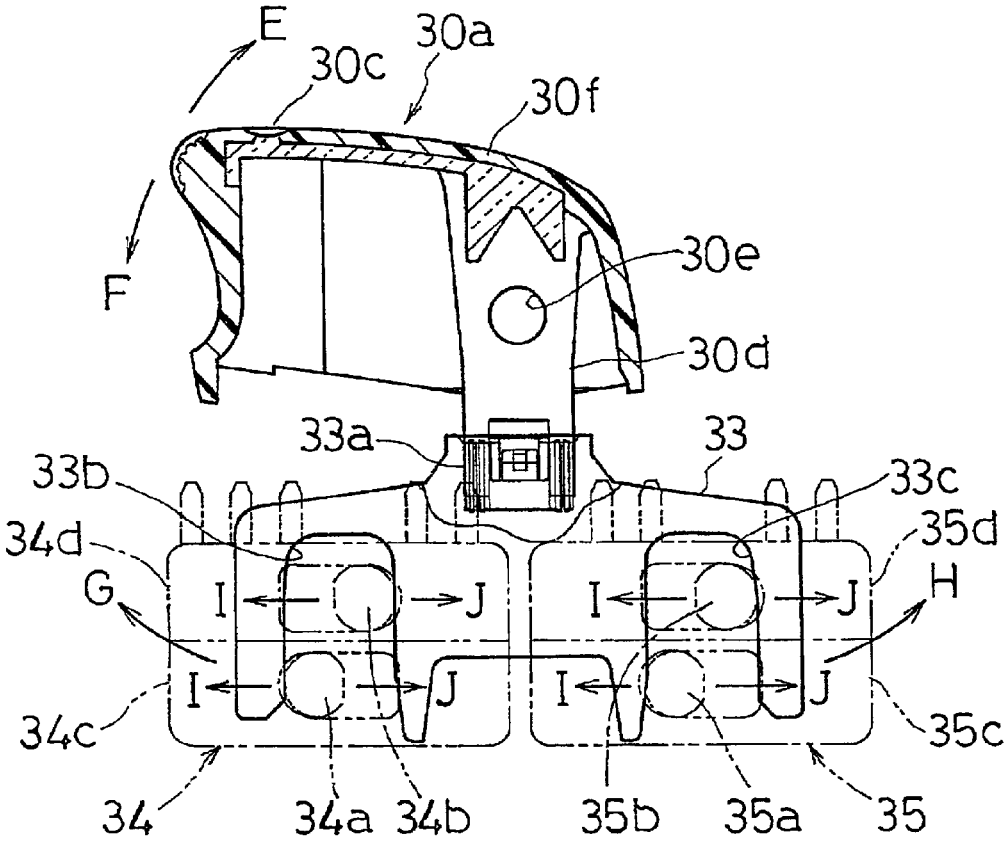
FIG. 11 describes a window operating switch in a fourth preferred embodiment of the present invention.

The first and second window operating switches 30*a*, 30*b* rock on studs 21*e*, 21*f* when the respective knob 30*f*, 30*g* is raised or lowered as shown in FIG. 11. The first and second window operating switches 30*a*, 30*b* have two operating positions (steps) in both directions (up and down).

Lifting the first window operating switch 30*a* to the first operating (step) position allows the operator to manually raise the driver or right rear window. Lifting the knob 30*f* of first window operating switch 30*a* further to the second operating position accesses an automatic mode in which the driver or right rear window is raised automatically to the fully closed position.

The second window operating switch 30*b*, which is a two-step rocker switch having a knob 30*g*, is located at the fourth control location 21*d*. When knob 30*g* of second window operating switch 30*b* is pushed to a first operating position (step), the passenger side or left rear window can be manually lowered (opened). When knob 30*g* is further depressed to a second operating position, the passenger side or left rear window can be automatically lowered to the fully open position.

The second window operating switch 30*b* has a function for manually rasing the passenger side or left rear window as a result of knob 30*g* being lifted to the first operating position. It also has a function for automatically raising the passenger side or left rear window all the way closed when the knob 30*g* is further lifted to a second operating position.

It will be obvious to one with ordinary skill in the related art that case 21 can be made smaller overall, and the arm rest in which case 21 is installed can therefore be made slimmer, because the number of window operating switches is smaller than in a conventional automotive power window switch. In addition, the first window operating switches 30*a* and 30*b* are also arranged in the case 21 to match the locations of the windows in the vehicle.

Figure 5:
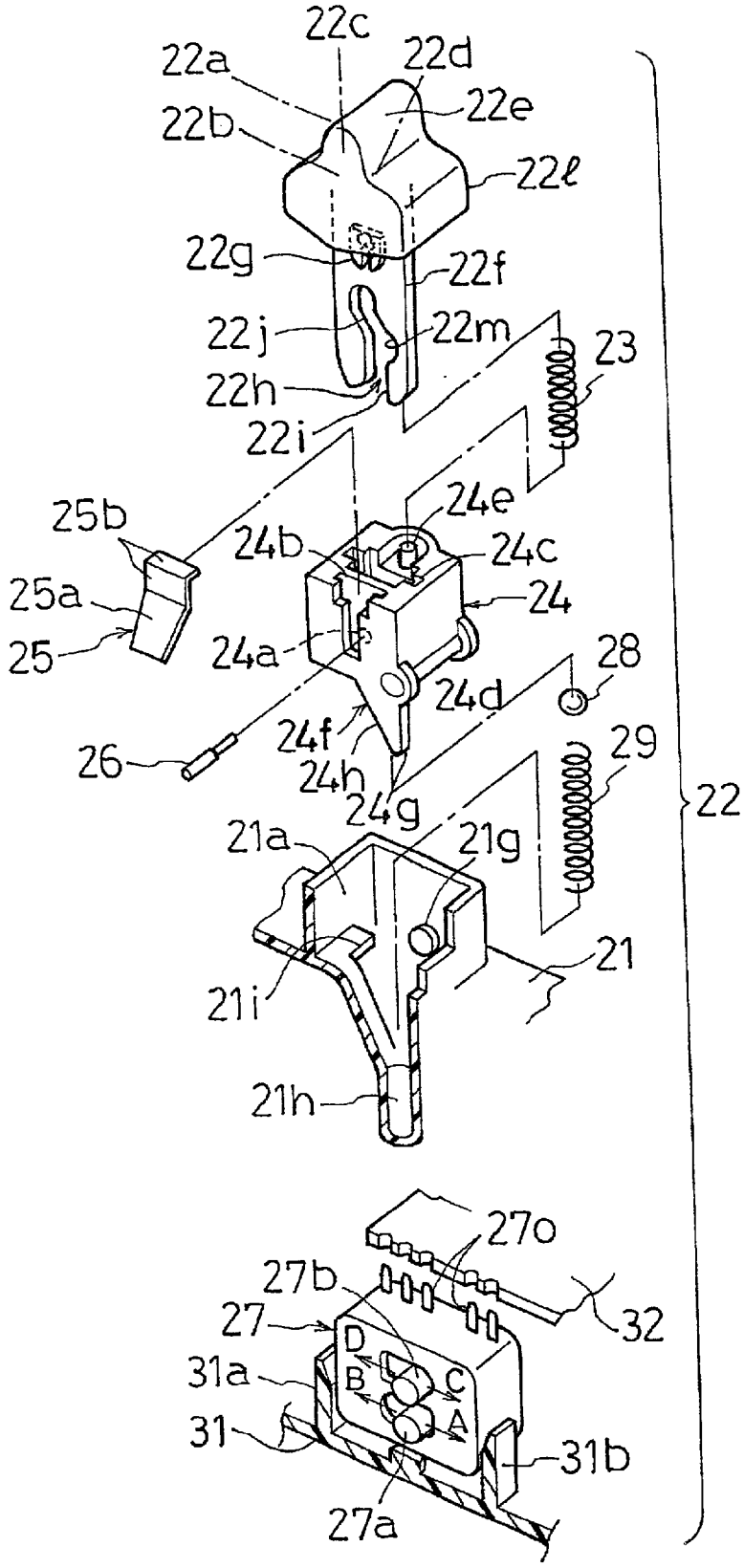
FIG. 5 is a partially exploded oblique view of a fourth preferred embodiment of the present invention.
Figure 6:
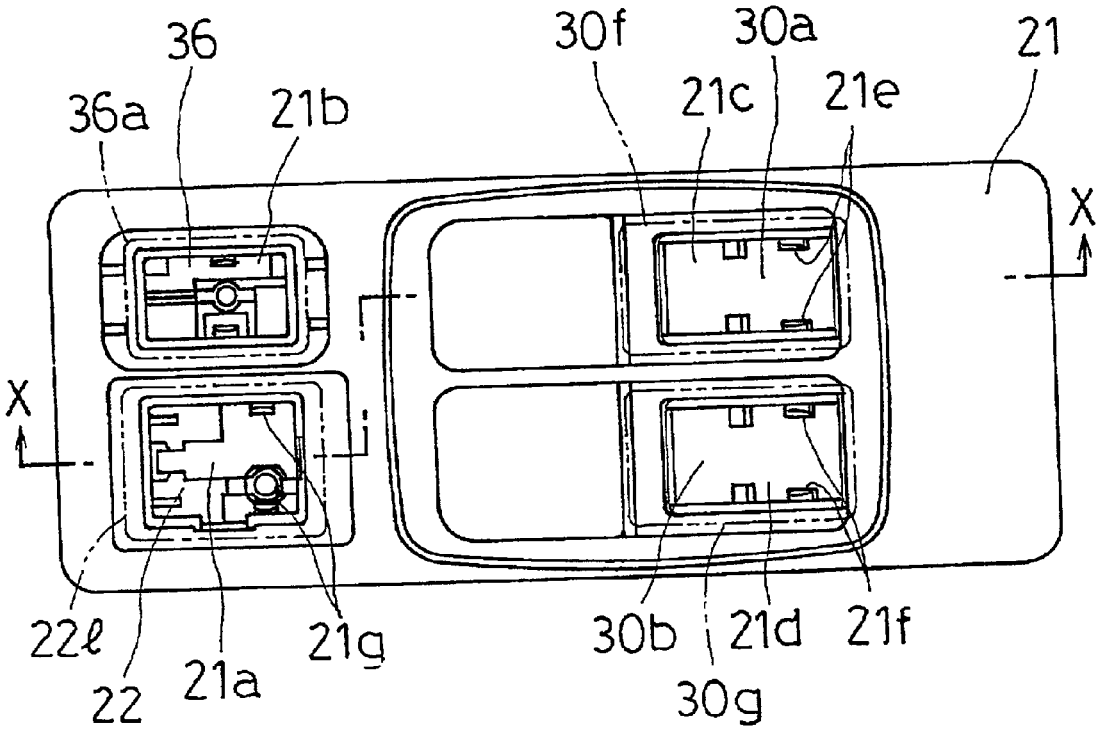
FIG. 6 is a plan view of the case in a fourth preferred embodiment of the present invention.

When the knob 22*l* of selector switch 22 is in the up position as shown in FIG. 5, selector switch 22 is in contact position 22*a*, that is, the position for unlocking window operation. When the knob 22*l* is pressed to the down position, selector switch 22 is in contact position 22*b* for locking window operation.

When knob 22*l* of selector switch 22 is in the center neutral position (pointing straight up), the selector switch 22 is at contact position 22*c*, that is, the front driver and passenger side windows can be operated using first and second window operating switches 30*a* and 30*b*. When selector switch 22 is at this contact position 22*c*, the rear windows cannot be operated.

When knob 22*l* of selector switch 22 is rocked from contact position 22*c*, the selector switch 22 is at contact position 22*d* enabling the left and right rear windows to be operated using first and second window operating switches 30*a* and 30*b*. When selector switch 22 is at this contact position 22*d*, the front windows cannot be operated.

Figure 8:
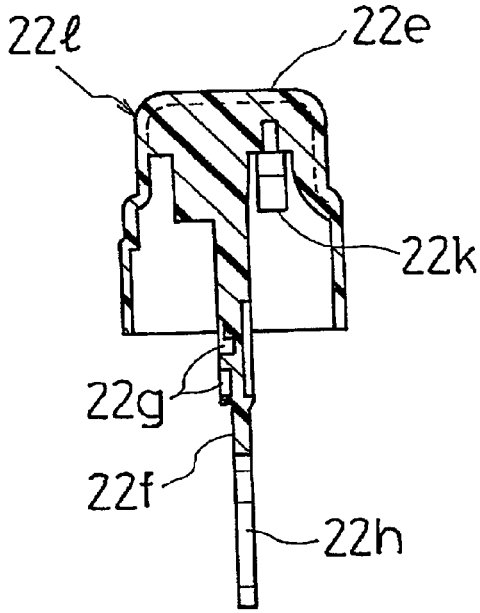
FIG. 8 is a section view of a knob in a fourth preferred embodiment of the present invention.

The knob 22*l* of selector switch 22 is molded to integrate the top button head 22*e* and operating lever 22*f* therebelow as shown in FIG. 8. The operating lever 22*f* has a shaped slot 22*h* and a push-lock cam 22*g*. The selector switch 22 is inserted to rocker body 24 so that it can move freely up and down by way of return spring 23, which automatically returns knob 22*l*.

The operating lever 22*f* passes through-hole 24*c* in rocker body 24 so that shaped slot 22*h* engages first and second sliding studs 27*a* and 27*b* of switch unit 27. By engaging hole 24*d* with stud 21*g* of first control position 21*a* in case 21, rocker body 24 rocks around stud 21*g* in conjunction with knob 22*l*.

Shaped slot 22*h* has a longitudinal slot 22*i* for engaging first sliding stud 27*a* of switch unit 27 at the end, and a sloped slot 22*j* contiguous to longitudinal slot 22*i* for engaging second sliding stud 27*b* of switch unit 27. This first sliding stud 27*a* floats inside longitudinal slot 22*i* when knob 22*l* is pressed. When knob 22*l* is pressed, sloped slot 22*j* pushes on second sliding stud 27*b*, causing it to move. An escape slot 22*m* allowing second sliding stud 27*b* to float when knob 22*l* is rocked is formed at the junction between longitudinal slot 22*i* and sloped slot 22*j*.

Return spring 23 is a coil spring that urges upward on knob 22*l* so that cam 22*g* contacts lock pin 26 and holds selector switch 22 in the on or off position. The top end of return spring 23 fits onto spring mount 22*k* shown in FIG. 8, and the bottom end fits onto spring mount 24*e* shown in FIG. 5. Spring mounts 22K, and 24*e* each have a protrusion that fits loosely into an end of return spring 23, which is a coil spring as noted above, and an annual groove. Spring mount 22*k* is formed juxtaposed to operating lever 22*f*, which is formed in the middle of selector switch 22 knob 22*l*. spring mount 24*e* is formed juxtaposed to through-hole 24*c* formed in the middle of rocker body 24.

Cam 22*g* is formed integrally to the side of operating lever 22*f*, or is formed as a separate part that is then bonded in place. Leaf spring 25 applies constant pressure to lock pin 26, the end of which is thus held in contact with the cam 22*g*, and holds selector switch 22 in the on or off position.

Lock pin 26, which is thus pressed against cam 22*g*, is a metal rod. Lock pin 26 passes through lateral hole 24*a* in rocker body 24 with one end of lock pin 26 contacting leaf spring 25 pressed to cam 22*g*.

The leaf spring 25 urging lock pin 26 has a spring part 25*a* that is flexible and pushes on lock pin 26, and a mounting part 25*b* for mounting leaf spring 25 to the rocker body 24. The spring part 25*a* of leaf spring 25 is inserted to and held in longitudinal hole 24*b* formed in rocker body 24.

Figure 9:
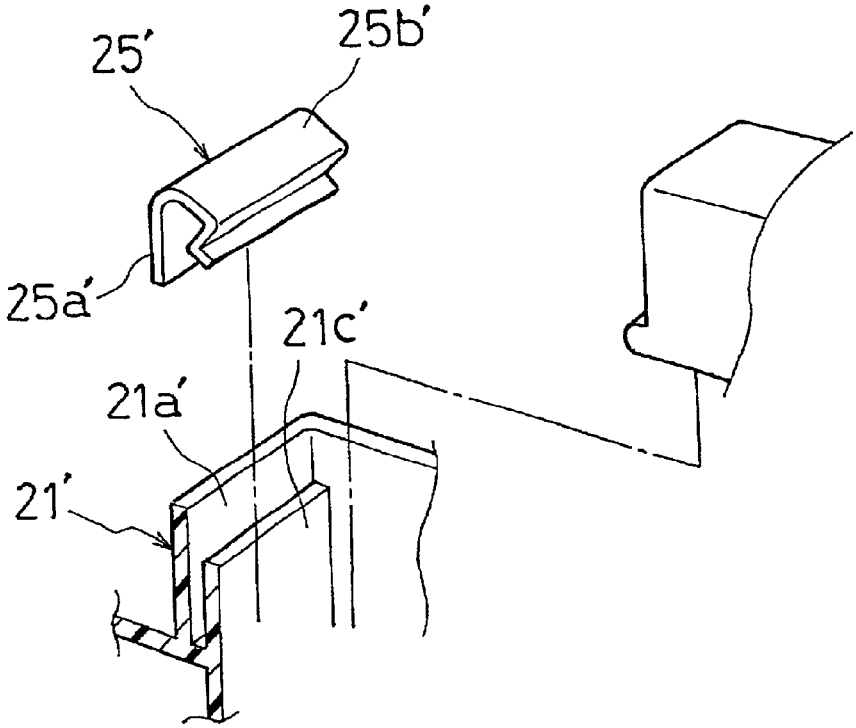
FIG. 9 is an enlarged oblique view of part the leaf spring according to an alternative version of the present invention.

It should be noted that the leaf spring 25 shown in FIG. 5 can be alternatively comprised as leaf spring 25' with a mounting part 25*b*' as shown in FIG. 9. The mounting part 25*b*' in this case is a flexible part that is press fit to leaf 21*c*', which is inset to first control location 21*a*' of case 21', to secure leaf spring 25'. Note that this mounting part 25*b*' is a flexible piece that covers and clamps on leaf 21*c*'.

Hole 24*d* formed in both sides of rocker body 24 is engaged with stud 21*g* of case 21, thus rockably supporting the rocker body 24 with a suitable body 28 urged by a suitable spring 29 pushing on a suitable protrusion 24*f* formed on the bottom of the rocker body 24. The rocker body 24 is held with the knob 22*l* of selector switch 22 in the vertical contact position 22*c* as a result of body 28 pushing on incline 24*g* of protrusion 24*f*. Furthermore, protrusion 24*f* is also held with knob 22*l* at the rocked contact position 22*d* as a result of body 28 pushing on incline 24*h*.

Suitable spring 29 is inserted and held in spring hole 21*h* formed inside first control location 21*a* of selector switch 22.

As shown in FIG. 5, switch unit 27 is held with the bottom thereof fit between support fingers 31*a* and 31*b*, which are formed protruding from the base 31. The plural contacts 27*c* protruding at the top of switch unit 27 are inserted to through-holes 32*a* in substrate 32 and soldered in place.

Figure 10:
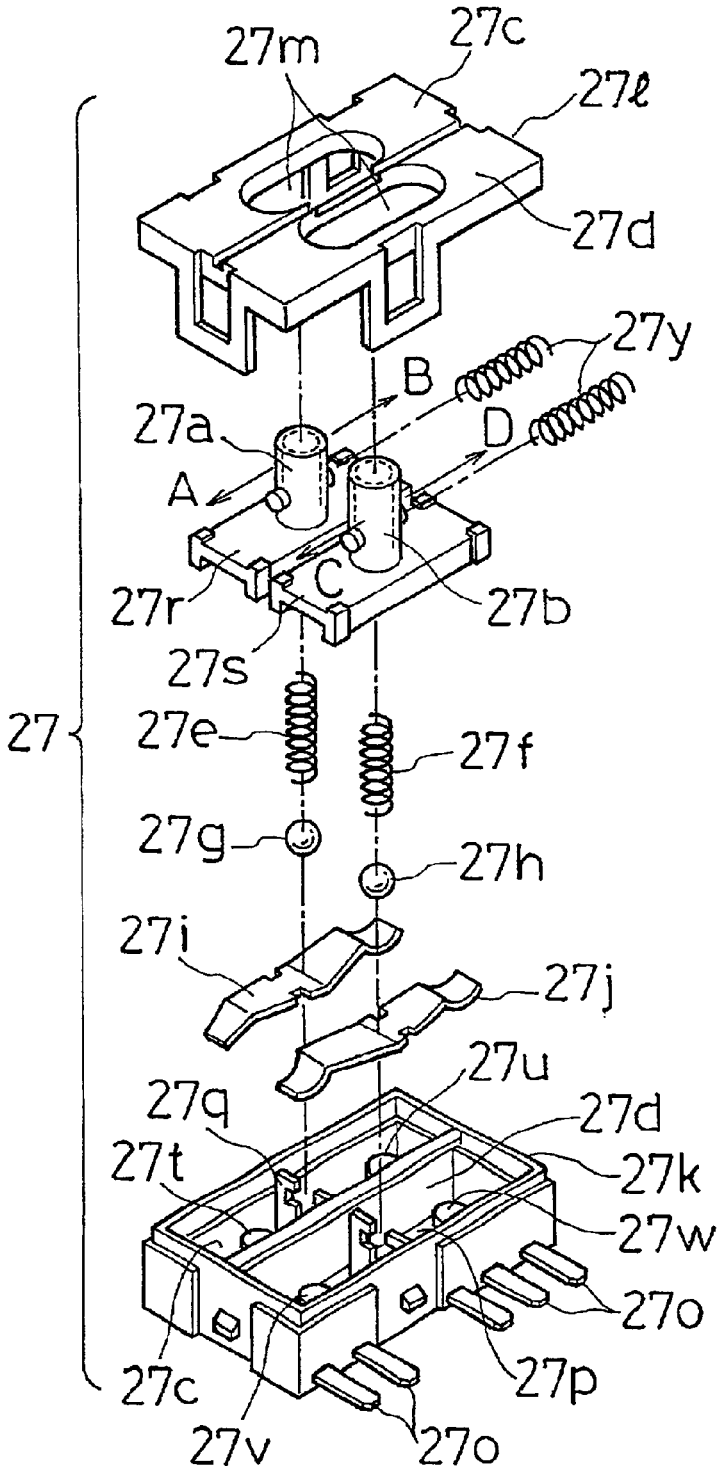
FIG. 10 is an enlarged partially exploded oblique view of a switch unit in a fourth preferred embodiment of the present invention.

FIG. 10 is a partially exploded view of switch unit 27 according to this preferred embodiment of the invention. This switch unit 27 has a selector switch part 27*c*, and a window lock switch part 27*d* for locking and unlocking the windows. The selector switch part 27*c* is for switching the knob 22*l* of selector switch 22 between a front seat window position for operating the front windows, and a rear seat window position for operating the rear windows.

The first and second sliding studs 27*a* and 27*b* are tubular members to which contact springs 27*e*, 27*f* and steel balls 27*g*, 27*h* are inserted and held. A flat sliding base 27*r*, 27*s* is integrally formed to first and second sliding studs 27*a*, 27*b*. The end of first and second sliding studs 27*a*, 27*b* passes through elliptical hole 27*m* in cover piece 27*l*. The first and second sliding studs 27*a*, 27*b* engage shaped slot 22*h* of operating lever 22*f*, and the side of each stud is pushed by a return spring 27*y*. Each contact spring 27*e*, 27*f* pushes on contact plate 27*i*, 27*j* by way of intervening steel ball 27*g*, 27*h*. One end of each return spring 27*y* engages first and second sliding studs 27*a*, 27*b*, and the other end pushes against the inside wall of switch case 27*k*.

Each contact plate 27*i*, 27*j* is rockably supported by engaging the longitudinal center thereof with the U-shaped notch in common contacts 27*p*, 27*q*. The switch case 27*k* which cover piece 27*l* engages is insert molded to form common contacts 27*p*, 27*q*, fixed contacts 27*t*, 27*u*, 27*v*, and 27*w*, and contacts 27*o*. The contact plates 27*i*, 27*j* contact the fixed contacts 27*t*, 27*u*, 27*v*, and 27*w*. It should be noted that fixed contact 27*v* is the contact contacted by contact plate 27*j* when selector switch 22 window lock switch part 27*d* is in the off position, and can be omitted.

The cover piece 27*l* holds first and second sliding studs 27*a*, 27*b* urged in contact with contact spring 27*e*, 27*f*, and closes the opening to switch case 27*k*.

When the knob of selector switch 22 is raised in contact position 22*a*, second sliding stud 27*b* is at the bottom end of sloped slot 22*j*, moved in the direction of arrow C in FIG. 5 and FIG. 10 with the window lock switch part 27*d* in the off position. The first sliding stud 27*a* at this time is positioned at the bottom end of longitudinal slot 22*i* in operating lever 22*f*.

When knob 22*l* of selector switch 22 is then depressed, window lock switch part 27*d* switches to the on position at contact position 22*b*. When knob 22*l* of selector switch 22 descends, second sliding stud 27*b* is pushed into sloped slot 22*j*, and moves in the direction of arrow D. Contact plate 27*j* then rocks on common contact 27*p* to the opposite side, and window lock switch part 27*d* switches to the on position. At this time first sliding stud 27*a* is at the top end of longitudinal slot 22*i* in operating lever 22*f*.

When selector switch 22 knob 22*l* is in the vertical position at contact position 22*c*, first sliding stud 27*a* is at the front seat contact position 22*c*, enabling operation of the front windows, moved in the direction of arrow A in FIG. 5 and FIG. 10.

When selector switch 22 knob 22*l* rocks to the back seat contact position 22*d*, the windows that can be operated by first and second window operating switches 30*a* and 30*b* change to the rear seat windows. When selector switch 22 knob 22*l* then rocks to the second contact position 22*d*, first sliding stud 27*a* is pushed by the edge of longitudinal slot 22*i* and moves in the direction of arrow B. Contact plate 27*i* then rocks to the opposite side on common contact 27*q*, which rockably supports contact plate 27*i*, and selector switch part (contacts) 27*c* changes to the rear seat position. Second sliding stud 27*b* at this time floats freely in sloped slot 22*j*.

Figure 7:
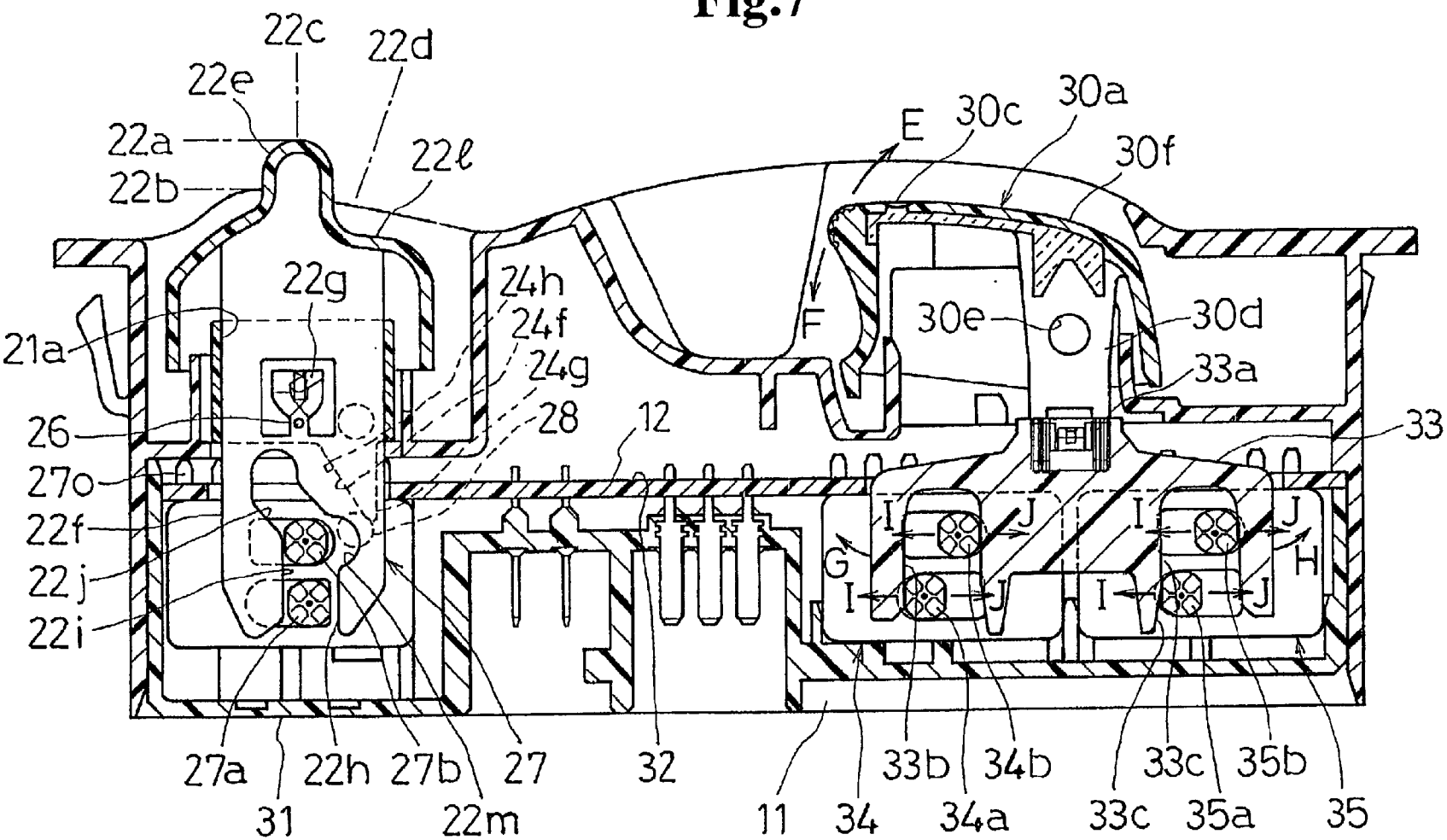
FIG. 7 is a section view through line X—X in FIG. 6.

The construction of first and second window operating switches 30*a* and 30*b* is described in detail next below with reference to FIG. 7 and FIG. 11. It should be noted that first and second window operating switches 30*a* and 30*b* are identical in construction, and the following description therefore refers to the first window operating switch 30*a* only.

First window operating switch 30*a* has an operating lever 30*d* integrally connected to movable selector 33, and is rockably supported on case 21 by engaging stud 21*f* in hole 30*e*. An indicator (not shown in the figure) for illuminating lighting indicator 30*c* is disposed inside knob 30*f* of first window operating switch 30*a*. This lighting indicator 30*c* is formed by overlaying a photoconductor inside the opaque knob 30*f*. The end 30 of operating lever 30*d* is fit onto connector 33*a* of movable selector 33. As a result, movable selector 33 rocks around hole 30*e* in conjunction with knob 30*f* of first window operating switch 30*a*.

The movable selector 33 has a first notch 33*b* and second notch 33*c* for respectively engaging the sliding studs 34*a*,

34*b*, 35*a*, 35*b* of the front seat switch unit 34 and rear seat switch unit 35, which are disposed in line with each other.

The front seat switch unit 34 and rear seat switch unit 35 are switches substantially identical in structure to the switch unit 27 described above. The front and rear seat switch units 34, 35 are positioned before and after the operating lever 30*d*, the bottom side thereof fit to base 31 and the top fixed to substrate 32 similarly to switch unit 27.

The return spring (not shown in the figure) disposed inside front and rear seat switch units 34, 35 is also used to automatically return the knob 30*f*, 30*g* of first and second window operating switches 30*a* and 30*b* to the off position. It should be noted that disposing a return spring to both sides of sliding studs 34*a*, 34*b*, 35*a*, 35*b* is sufficient to increase the operating force of first and second window operating switches 30*a* and 30*b* as desired.

Front and rear seat switch units 34, 35 each have two parts: forward switch part 34*c*, 35*c* where sliding stud 34*a*, 35*a* operates to lower the window, and reverse switch part 34*d*, 35*d* where sliding stud 34*b*, 35*b* operates to raise the window. For example, if knob 30*f* of first window operating switch 30*a* is lifted in the direction of arrow E, movable selector 33 rotates in the direction of arrow G around hole 30*e*. Guided by movable selector 33, sliding studs 34*a*, 34*b*, 35*a*, 35*b* of front and rear seat switch units 34, 35 move in the direction of arrow I, forward switch part 34*c*, 35*c* turns on, and the window rises.

It should be noted that if selector switch 22 knob 22*l* is in the front seat contact position 22*c* at this time, the rising window will be the driver's window because only the front seat switch unit 34 operates at this time. Likewise, if the selector switch 22 knob 22*l* is in the rear seat contact position 22*d*, only the rear seat switch unit 35 operates and the right rear window thus rises.

If knob 30*f* of first window operating switch 30*a* is pushed in the direction of arrow F, movable selector 33 rotates pivoting on hole 30*e* in the direction of arrow H. In this case, sliding studs 34*a*, 34*b*, 35*a*, 35*b* of front and rear seat switch units 34, 35 move in the direction of arrow J guided by movable selector 33, reverse switch part 34*d*, 35*d* turns on and the window descends.

It should be noted that if selector switch 22 knob 22*l* is in the front seat contact position 22*c* at this time, the descending window will be the driver's window because only the front seat switch unit 34 operates at this time. Likewise, if the selector switch 22 knob 22*l* is in the rear seat contact position 22*d*, only the rear seat switch unit 35 operates and the right rear window thus opens.

Thus comprised, a power window switch according to this fourth preferred embodiment of the present invention operates as described below.

For example, if mode selector switch 22 is operated so that knob 22*l* is in the vertical position at contact position 22*c*, first window operating switch 30*a* switches to the controller for operating the driver's side windows, and second window operating switch 30*b* switches to the controller for operating the passenger's side windows. Then, if the knob 30*f* of the first window operating switch 30*a* is lifted to the first operating position (step), the movable contact for raising (closing) the window contacts the fixed contact for as long as knob 30*f* of first window operating switch 30*a* is held in this first operating position. The motor thus turns and the driver's side window rises. When the knob 30*f* of first window operating switch 30*a* is released, the movable contact for raising the window returns automatically to the off position, the motor stops, and the window stops moving.

If the knob 30*f* of first window operating switch 30*a* is lifted further to the second operating position (step), a solenoid (not shown in the figure) in the motor controller holds the switch at this second operating position, or the equivalent circuit state is held electrically by means of a relay (not shown in the figure), so that the window-raising movable contact remains in contact with the fixed contact. Operation thus continues until the driver's window rises all the way closed. When the window is completely closed, window-raising movable contact returns to the off position, the motor stops, and the window stops moving.

If selector switch 22 knob 22*l* remains in the front seat contact position 22*c* and knob 30*f* of first window operating switch 30*a* is pushed down to the first operating position, the movable contact for lowering (opening) the window contacts the fixed contact for as long as knob 30*f* of first window operating switch 30*a* is held in this first operating position. The motor thus reverses and the driver's side window descends. When the knob 30*f* of first window operating switch 30*a* is released, the movable contact for lowering the window returns automatically to the off position, the motor stops, and the window stops moving.

If the knob 30*f* of first window operating switch 30*a* is pushed further to the second operating position (step), a solenoid (not shown in the figure) in the motor controller holds the switch at this second operating position, or the equivalent circuit state is held electrically by means of a relay (not shown in the figure), so that the window-lowering movable contact remains in contact with the fixed contact. Operation thus continues until the driver's window descends all the way open. When the window is completely open, window-lowering movable contact returns to the off position, the motor stops, and the window stops moving.

If the selector switch 22 knob 22*l* is moved to the rear seat contact position 22*d*, the first window operating switch 30*a* operates in the same way to control the right rear window, and second window operating switch 30*b* operates in the same way to control the left rear window.

If selector switch 22 knob 22*l* is pressed from contact position 22*a* to contact position 22*b*, the power window switches at all seats other than the driver's seat are disabled so that the windows cannot be operated.

The number of control knobs is reduced and cost is thus reduced in a power window switch according to this preferred embodiment of the present invention by combining push-lock switch and rocker switch functions in a single selector switch 22, which is then used for switching the operating mode of the first and second window operating switches 30*a* and 30*b* of the power window switch between the front and back seat windows, and controlling a window lock function.

Furthermore, by eliminating dedicated switches for operating the rear windows, this fourth preferred embodiment of the invention provides a power window switch that is small overall and can prevent such unintentional operation as operating a switch for a rear window when intending to operate one of the front windows.

Figure 12:
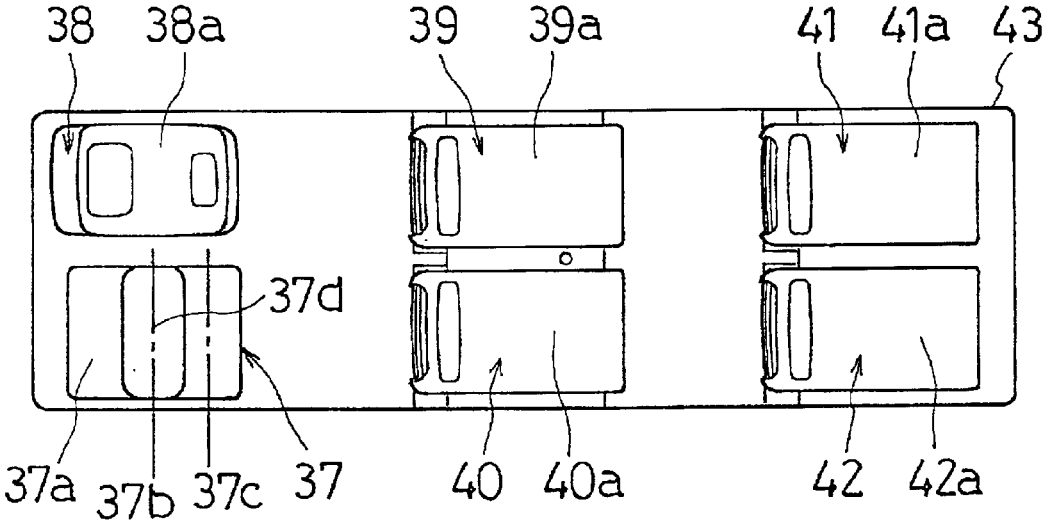
FIG. 12 is a plan view of a fifth preferred embodiment of the present invention.

Embodiment 5 (FIG. 12)

A power window switch according to a fifth exemplary embodiment of the present invention is described next below with reference to FIG. 12.

An automotive power window switch according to this fifth embodiment of the invention is directed to providing a compact power window switch unit for a van or other type of vehicle having up to six windows in three rows.

It should be noted that selector switch 37 according to this fifth exemplary embodiment is identical to the selector switch 22 of the fourth embodiment described above, and differs only in that contact position 22*c* of knob 37*a* is the contact position for windows in the second row, and contact position 22*d* of Knob 37*a* is the contact position for windows in the third row.

In addition, door lock switch 38 is identical in application and construction to the door lock switch 36 of the fourth preferred embodiment. Yet further, the first window operating switch 39, second window operating switch 40, third window operating switch 41, and fourth window operating switch 42 are also identical in application and construction to the first and second window operating switches 30*a* and 30*b* of the fourth preferred embodiment.

The selector switch 37 comprises the functions of a rocker switch having a knob 37*a* that rocks between two in-line contact positions, and a push-button used for a window lock function. More specifically, the knob 37*a* rocks between a second row contact position 37*b* for operating windows in the second row, and a third row contact position 37*c* for operating windows in the third row. The push-button 37*d* located in the middle of knob 37*a* is depressed to lock the windows so that they cannot be opened and closed.

Referring to FIG. 12, case 43 of this automotive power window switch is populated with six knobs 37*a*, 38*a*, 39*a*, 40*a*, 41*a*, 42*a* for the selector switch 37, door lock switch 38, and first to four window operating switches 39, 40, 41, 42, respectively. This case 43 is mounted in the driver's side arm rest, for example. The four window operating switches 39, 40, 41, 42 are positioned in correlation to the front-back direction of the vehicle and the first to third rows.

Using both a rocker switch and push-button switch, the selector switch 37 is a combination row selector and window lock switch. The door lock switch 38 locks and unlocks the door locks. The first window operating switch 39 is a dedicated switch for controlling the driver's window, and second window operating switch 40 is a dedicated switch for controlling the front seat passenger window. The first window operating switch 39 can be operated by lifting up or pushing down on the knob as described in the previous embodiments, and enables two-step operation in both directions. The third and fourth window operating switches 41, 42 have one switch unit disposed to the operating level as in a conventional power window switch.

The third window operating switch 41 is for operating the right window in the second or third row. The fourth window operating switch 42 is for operating the left window in the second or third row. A movable selector for operating two switch units as described in the fourth exemplary embodiment above is further linked to the operating lever of the third and fourth window operating switches 41, 42. That is, the switch units are constructed as shown in FIG. 11 with the front seat switch unit 34 shown in FIG. 11 being used as the switch unit for the second row, and the rear seat switch unit 35 being used as the switch unit for the third row.

For example, if knob 37*a* of selector switch 37 is set to the second row contact position 37*b* and knob 42*a* of fourth window operating switch 42 for operating the left-side window is lifted up to the first operating position, the window motor turns and the left window in the second row rises for as long as knob 41*a* is held down. When knob 42*a* is released, the switch returns automatically to the off position, the motor stops, and the window stops moving.

If knob 37*a* of selector switch 37 is set to the third row contact position 37*c* and knob 41*a* of third window operating switch 41 for operating the right side window is pushed down, the right side window in the third row opens for as long as knob 41*a* is held down. When the knob 41*a* is released, the switch returns automatically to the off position, the motor stops, and the window stops.

Depressing knob 38*a* of door lock switch 38 locks all doors.

It will thus be obvious that a power window switch according to this fifth exemplary embodiment of the invention uses five knobs 37*a*, 39*a*, 40*a*, 41*a*, 42*a*, including selector switch 37 that also operates as a window lock switch, to operate six windows, thus reducing the number of window operating switches and reducing cost. Furthermore, by integrating the switches used to control windows in the second and third rows, this fifth exemplary embodiment of the invention provides a power window switch that is small overall.

[Effects of the Invention]

Thus comprised, a power window switch according to the present invention provides the following benefits and effects.

A power window switch according to a first aspect of the present invention has a switch for operating power windows by means of window operating switches for raising and lowering a windows in a motor vehicle, and a selector switch for selecting the windows that can be operated, where the selector switch also has the functionality of a window lock switch for disabling window operation. As a result, the present invention provides a small, low cost power window switch with few window operating switches without impairing power window switch functionality. It is therefore also possible to reduce the overall length and width of the power window switch unit, which can thus be easily installed to the desired location.

In this power window switch the window operating switch is preferably a single switch; and the selector switch comprises a single switch knob with a contact position for selecting the windows to operate, and a contact position for disabling power window operation. Thus comprised, the present invention can provide a power window switch that uses only two switches to raise and lower each of the four windows (right and left, front and back), as well as lock and unlock the windows and door locks. By thus reducing the six window operating switches of a conventional power window switch device to only two, the power window switch can be downsized, the arm rest to which it is installed can be slim, and the distance that the arm rest projects from the door into the cabin can be reduced. The passenger cabin can thus be made more comfortable. Furthermore, by reducing the number of window operating switches, the number of parts and the number of assembly steps can be greatly reduced, thus enabling cost reduction.

Yet further preferably, the selector switch has a rotary switch knob, and contact positions arranged as follow: a window lock contact position for disabling window operation in the center; a driver's side contact position for operating the driver's window is right adjacent to the window lock contact position; a right rear window contact position for operating a right rear window is right adjacent to said driver's side contact position; a front passenger window contact position (2*d*) for operating a front passenger window is left adjacent to the window lock contact position; and a left rear window contact position for operating a left rear window is left adjacent to the front passenger window contact position. The contact positions of the mode selector switch can thus be matched to the location of particular seats (windows) in the vehicle. Operating the window operating switches by blind touch is thus possible, and a power window switch that is easy to operate can be provided.

Alternatively in a power window switch according to this first aspect of the invention the window operating switch comprises two switches disposed side by side; and the selector switch comprises a single switch knob with a switch for selecting front or back seat window operation and, when pressed, disabling window operation. It is thus possible to provide a power window switch in which two window operating switches are used to control operating the four windows (right and left, front and back), and one window operating switch for locking and unlocking the power windows and selecting the windows to be operated by the other two window operating switches. It is thus possible to reduce the number of parts and the number of assembly steps, reduce the cost, and provide an overall small switch unit without eliminating any switch functionality.

Yet further alternatively in a power window switch according to this first aspect of the invention the selector switch comprises both a rotary switch for selecting two contact positions for selecting a front seat and back seat position, and a push-button switch for disabling window operation.

It is therefore possible to provide a power window switch that can lock and unlock the power windows, and select the power windows to operate, using only one rotary window operating switch. It is thus possible to reduce the number of parts and the number of assembly steps, and reduce the cost, without eliminating any switch functionality.

Yet further alternatively in a power window switch according to this first aspect of the invention the selector switch comprises a switch movable in two directions for selecting front window operation or rear window operation, and a switch for disabling window operation. It is therefore possible to provide a power window switch that can lock and unlock the power windows, and select the power windows to operate, using only one rocker type window operating switch. It is thus possible to reduce the number of parts and the number of assembly steps, and reduce the cost, without eliminating any switch functionality.

A further switch for operating the power windows of an automobile and having a window operating switch for raising and lowering a vehicle window, and a selector switch for selecting a window to be operated by window operating switch, is characterized in another aspect of the present invention by the selector switch combining the functions of a rocker switch for moving a knob in two directions to select operation of a front seat window or rear seat window, and a push-lock switch for disabling and enabling window operation when the knob is pressed. It is therefore possible to provide a compact, low cost power window switch having a small number of window operating switches.

The selector switch in this aspect of the present invention preferably is in a contact position for operating a front seat window when the knob of selector switch is in an upright position, and is in a contact position for operating a back seat window when the knob of the selector switch is rocked to one side. It is therefore possible to provide a power window switch wherein knob operation is easy when the knob of the selector switch is in the contact position for operating a first window operating switch, which is the most frequently used front seat window.

A multiple switch device for operating automobile power windows in a first row, second row, and third row according to a further aspect of the present invention has first to fourth window operating switches for operating first row, second row, and third row power windows; and a selector switch for selecting whether the third and fourth window operating switches operate the power windows of the second row or third row. It is thus possible to operate windows in a first, second, and third row using fewer knobs than there are windows. It is therefore possible to provide a power window switch ideally suited for use in vans and other types of vehicles having six power windows. Furthermore, by providing first and second window operating switches used for operating the windows in the first row, that is, the windows in the driver's seat row that are used most frequently and which must on occasion be immediately operable, independently so that they can be operated without first being selected, the windows in the first row can always be immediately operated. An overall compact switch unit having fewer switch knobs than windows can thus be provided without impairing driving safety.

Preferably in this case the selector switch combines functions of a rocker switch for moving in two directions to select operation of a second row window or a third row window, and a push-lock switch for disabling and enabling window operation. By thus using independent dedicated switches to operate the most frequently used first row windows, and enabling the window operating switches for the relatively less frequently used second and third row windows to be appropriately selected using a switch combining the functions of a rocker switch and push-button switch, the number of switch knobs on the power window switch unit can be reduced, the overall power window switch unit size can be reduced for easy installation in a suitable narrow space such as an arm rest, and cost can be reduced.

Yet further preferably, the selector switch is in a contact position for operating a second row window when the knob of selector switch is in an upright position, and is in a contact position for operating a third row window when the knob is rocked to one side. By thus enabling operation of the window lock switch at the same contact position used for operating the second row windows, which are used more frequently than the third row windows, the window lock switch can be easily operated at the most frequent contact position.

A power window switch according to a further aspect of the present invention comprises a knob having protruding from the bottom thereof an operating lever for operating a switch unit, and a single operating part enabling push-action and rocker-action operations; a rocker body movably supported to a case on a pivot with operating lever of knob passing freely up and down therethrough; a case having a through-hole for operating lever passing therethrough; and a plurality of switch units operated by movement of first and second sliding studs, which engage a shaped slot formed in the operating lever of the knob. It is thus possible to provide a multiple switch device enabling both push-button switch and rocker switch operations with a single switch unit. It is therefore possible to reduce the number of switch units, reduce the number of parts and assembly steps, and reduce cost, thus downsizing the overall switching device so that it can be easily installed in a suitable place. Furthermore, a multifunction switch combines the functions of a rocker switch that rocks to a desired contact position in conjunction with the switch (rocker) body, and a push-lock switch. One switch can thus be used for two purposes. Accidental operation can also be prevented by using two different switch operations, that is, a rocker switch operation and push-button operation, for the two purposes for which the two-function switch is used.

Preferably in this power window switch the knob has a cam on a side of operating lever; the rocker body has a lock pin for engaging the cam and a leaf spring for urging the lock pin, and forms a suitable surface contacted by a suitable body, which is urged by a suitable spring; and the case has a positioning part for placing the knob. The through-hole, a substantially tubular protrusion forming a blind hole for holding the suitable spring, and stud hole for pivotably supporting the rocker body are formed inside the positioning part. In this case a single switch can be used for two switch operations, that is, a rocker switch operation and push-button operation, one switch can be used for a plurality of purposes, and the number of operation knobs on the switch device can be reduced, thereby simplifying the switch device. In addition, by making the blind hole substantially a cylindrical shape and placing a suitable spring and a suitable body inside the positioning part pivotably supporting the rocker body, parts around the blind hole in the case thicker than the depth of the blind hole, and the positioning part, can be plastically molded using a thin-wall material. The amount and cost of the resin material used for molding the case can thus be reduced, reducing overall cost. Furthermore, by placing the lock pin and spring conventionally disposed to the case in the rocker body, it is not necessary to install the lock pin to the case, the thickness of the case around the rocker body can be reduced, and overall switch weight can be reduced.

Yet further preferably in this power window switch, the shaped slot formed in the operating lever has a longitudinal slot in which the first sliding stud floats when the knob is pressed, a sloped slot, contiguous to the longitudinal slot, for pushing and moving the second sliding stud when the knob is pressed, and an escape slot in which second sliding stud moves freely when the knob is rocked. The second sliding stud engaged with the shaped slot in the depressed knob is thus allowed to move freely when the knob is further rocked to another contact position so that the push-lock switch can be held in the on state by the second sliding stud while the knob is rocked to turn the rocker switch on. Furthermore, by providing contiguously a longitudinal slot, inclined slot, and escape slot in the operating lever of the knob, and engaging the first and second sliding studs of the switch unit with this contiguous slot, the push-button and rocker operations of the knob can be reliably relayed. Further, when the knob is depressed and then further rocked to a rocker switch contact position, the second sliding stud will not catch in the slot, and a multiple switch device that can be easily and comfortably operated can be provided.

A multiple switch device according to a yet further aspect of the present invention comprises a switch having protruding from a bottom thereof an operating lever for operating switch units, and a rocking knob; a movable selector disposed to the operating lever of the switch for operating the two switch units. One of the switch units is operated by movement of a sliding stud engaging a first notch formed in the movable selector; and the other switch unit is operated by movement of a sliding stud engaging a second notch formed in the movable selector. A multiple switch device thus comprised enables one window operating switch to simultaneously operate a plurality of switch units. In addition, the number of switches, and therefore cost, can be reduced, the number of knobs is reduced to enable using a smaller case, and the multiple switch device can be easily installed in a suitable location.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A multiple switch device for operating a power window and having a window operating switch (3, 6, 7, 11, 12, 30*a*, 30*b*, 39, 40, 41, 42) for raising and lowering a vehicle window, and a selector switch (2, 5, 10, 22, 37) for selecting a particular window for operation, said multiple switch device characterized by the selector switch (2, 5, 10, 22, 37) also having a lock switch function for disabling window operation, wherein:

said window operating switch (3) is a single switch; and said selector switch (2) comprises one switch knob with a contact position (2*a*, 2*b*, 2*d*, 2*e*) for selecting each window to operate, and a contact position (2*c*) for disabling window operation, and wherein:

said selector switch (2) has a rotary switch knob, and contact positions (2*a*, 2*b*, 2*c*, 2*d*, 2*e*) are arranged as follow:

a window lock contact position (2*c*) for disabling window operation is a center position;

a driver's side contact position (2*b*) for driver's window operation is right adjacent to said window lock contact position (2*c*);

a right rear window contact position (2*a*) for operating a right rear window is right adjacent to said driver's side contact position (2*b*);

a front passenger window contact position (2*d*) for operating a front passenger window is left adjacent to the window lock position (2*c*); and a left rear window contact position (2*e*) for operating a left rear window is left adjacent to the front passenger window contact position (2*d*), wherein:

said window operating switch (6, 7, 11, 12) comprises two switches disposed side by side; and said selector switch (5, 10) comprises a single switch knob with a switch for selecting front or back seat window operation and, when pressed, disabling window operation.

2. A multiple switch device for operating a power window and having a window operating switch (3, 6, 7, 11, 12, 30*a*, 30*b*, 39, 40, 41, 42) for raising and lowering a vehicle window, and a selector switch (2, 5, 10, 22, 37) for selecting a particular window for operation, said multiple switch device characterized by the selector switch (2, 5, 10, 22, 37) also having a lock switch function for disabling window operation, wherein:

said window operating switch (3) is a single switch; and said selector switch (2) comprises one switch knob with a contact position (2*a*, 2*b*, 2*d*, 2*e*) for selecting each window to operate, and a contact position (2*c*) for disabling window operation, and wherein:

said selector switch (2) has a rotary switch knob, and contact positions (2*a*, 2*b*, 2*c*, 2*d*, 2*e*) are arranged as follow:

a window lock contact position (2*c*) for disabling window operation is a center position;

a driver's side contact position (2*b*) for driver's window operation is right adjacent to said window lock contact position (2*c*):

a right rear window contact position (2*a*) for operating a right rear window is right adjacent to said driver's side contact position (2*b*);

a front passenger window contact position (2*d*) for operating a front passenger window is left adjacent to the window lock position (2*c*); and a left rear window contact position (2*e*) for operating a left rear window is left adjacent to the front passenger window contact position (2*d*), wherein:

said selector switch (5) comprises a rotary switch for selecting two contact positions (5*a*, 5*b*) for selecting a front seat and back seat position, and a push-button switch for disabling window operation.

3. A multiple switch device for operating a power window and having a window operating switch (3, 6, 7, 11, 12, 30*a*, 30*b*, 39, 40, 41, 42) for raising and lowering a vehicle window, and a selector switch (2, 5, 10, 22, 37) for selecting a particular window for operation, said multiple switch device characterized by the selector switch (2, 5, 10, 22, 37) also having a lock switch function for disabling window operation, wherein:

said window operating switch (3) is a single switch; and said selector switch (2) comprises one switch knob with a contact position (2*a*, 2*b*, 2*d*, 2*e*) for selecting each window to operate, and a contact position (2*c*) for disabling window operation, and wherein:

said selector switch (2) has a rotary switch knob, and contact positions (2*a*, 2*b*, 2*c*, 2*d*, 2*e*) are arranged as follow:

a window lock contact position (2*c*) for disabling window operation is a center position;

a driver's side contact position (2*b* for driver's window operation is right adjacent to said window lock contact position (2*c*);

a right rear window contact position (2*a*) for operating a right rear window is right adjacent to said driver's side contact position (2*b*);

a front passenger window contact position (2*d*) for operating a front passenger window is left adjacent to the window lock position (2*c*); and a left rear window contact position (2*e*) for operating a left rear window is left adjacent to the front passenger window contact position (2*d*), wherein:

said selector switch (10, 22, 37) comprises a switch movable in two directions for selecting front window operation or rear window operation, and a switch for disabling window operation.

4. A multiple switch device for operating a power window and having a window operating switch (30*a*, 30*b*) for raising and lowering a vehicle window, and a selector switch (22) for selecting a window to be operated by window operating switch (30*a*, 30*b*), wherein:

the selector switch (22) combines functions of a rocker switch for moving a knob (22*l*) in two directions to select operation of a front seat window or rear seat window, and a push-lock switch for disabling and enabling window operation when the knob (22*l*) is pressed.

5. A multiple switch device as described in claim 4, wherein the selector switch (22) is in a contact position (22*c*) for operating a front seat window when the knob (22*l*) or selector switch (22) is in an upright position, and is in a contact position (22*d*) for operating a back seat window when the knob (22*l*) of selector switch (22) is rocked.

6. A multiple switch device for operating automobile power windows in a first row, second row, and third row, comprising:

first to fourth window operating switches (39, 40, 41, 42) for operating first row, second row, and third row power windows; and a selector switch (37) for selecting whether the third and fourth window operating switches (41, 42) operate the power windows of the second row or third row.

7. A multiple switch device for operating automobile power windows in a first row, second row, and third row, comprising:

first to fourth window operating switches (39, 40, 41, 42) for operating first row, second row, and third row power windows; and a selector switch (37) for selecting whether the third and fourth window operating switches (41, 42) operate the power windows of the second row or third row, wherein:

the selector switch (37) combines functions of a rocker switch for moving in two directions to select operation of a second row window or a third row window, and a push-lock switch for disabling and enabling window operation.

8. A multiple switch device as described in claim 7, wherein the selector switch (37) is in a contact position (37*b*) for operating a second row window when the knob (37*a*) of selector switch (37) is in an upright position, and is in a contact position (37*c*) for operating a third row window when the knob (37*a*) is rocked.

9. A multiple switch device comprising:

a knob (22*l*) having protruding from the bottom thereof an operating lever (22*f*) for operating a switch unit (27), and a single operating part (22*e*),enabling push-action and rocker-action operations;

a rocker body (24) movably supported to case (21) on a pivot with operating lever (22*f*) of knob (21*l*) passing freely up and down therethrough;

a case (21) having a through-hole (21*i*) for operating lever (22*f*) passing therethrough; and a plurality of switch units (27*c*, 27*d*) operated by movement of first and second sliding studs (27*a*, 27*b*), which engaged a shaped slot (22*h*) formed in the operating lever (22*f*) of the knob (22*l*).

10. A multiple switch device as described in claim 9, wherein:

the knob (22*l*) has a cam (22*g*) on a side of operating lever (22*f*);

the rocker body (24) has a lock pin (26) for engaging the cam (22*g*) and a leaf spring (25) for urging the lock pin (26), and forms a suitable surface (24*g*, 24*h*) contacted by a suitable body (28), which is urged by suitable spring (29); and the case (21) has a positioning part (21*a*) for placing the knob (22*l*); and the through-hole (21*i*), a tubular protrusion forming a blind hole (21*h*) for holding the suitable spring (29), and stud hole (21*g*) for pivotably supporting the rocker body (24) are formed inside the positioning part (21*a*).

11. A multiple switch device as described in claim 9 or 10, wherein:

the shaped slot (22*h*) formed in the operating lever (22*f*) has a longitudinal slot (22*i*) in which the first sliding stud (27*a*) floats when the knob (22*l*) is pressed, a sloped slot (22*j*), contiguous to the longitudinal slot (22*i*), for pushing and moving the second sliding study (27*b*) when the knob (22*l*) is pressed, and an escape slot (22*m*) in which second sliding stud (27*b*) moves freely when the knob (22*l*) is rocked.

12. A multiple switch device comprising:

a switch (30*a*, 30*b*, 41, 42) having protruding from a bottom thereof an operating lever (30*d*) for operating switch units (34, 35), and a rocking knob (30*f*); and a movable selector (33) disposed to the operating lever (30*d*) of the switch (30*a*, 30*b*, 41, 42) for operating the two switch units (34, 35);

one switch unit (34) being operated by movement of a sliding stud (34*a*, 34*b*), which engages a first notch (33*b*) formed in the movable selector (33), and an other switch unit (35) being operated by movement of a sliding stud (35*a*, 35*b*), which engages a second notch (33*c*) formed in the movable selected (33).

* * * * *